US007437112B2

(12) United States Patent
Yamaji

(10) Patent No.: US 7,437,112 B2
(45) Date of Patent: Oct. 14, 2008

(54) FIXING APPARATUS AND IMAGE FORMING APPARATUS

(75) Inventor: Hiroyuki Yamaji, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 61 days.

(21) Appl. No.: 10/575,453

(22) PCT Filed: Oct. 14, 2004

(86) PCT No.: PCT/JP2004/015116

§ 371 (c)(1),
(2), (4) Date: Apr. 12, 2006

(87) PCT Pub. No.: WO2005/038536

PCT Pub. Date: Apr. 28, 2005

(65) Prior Publication Data

US 2007/0110466 A1 May 17, 2007

(30) Foreign Application Priority Data

Oct. 16, 2003 (JP) ..... 2003-356607

(51) Int. Cl.
*G03G 15/20* (2006.01)

(52) U.S. Cl. ..... 399/328; 399/69

(58) Field of Classification Search ..... 399/69, 399/328, 330

See application file for complete search history.

(56) References Cited

U.S. PATENT DOCUMENTS 5,666,627 A * 9/1997 Yamaguchi ..... 399/330
6,400,924 B1 * 6/2002 Watanabe ..... 399/328 X
6,687,481 B2 * 2/2004 Watanabe et al. ..... 399/328
6,713,734 B2 * 3/2004 Suzuki ..... 399/328 X
6,810,230 B2 * 10/2004 Imai et al. ..... 399/328
6,872,925 B2 * 3/2005 Asakura et al. ..... 399/328 X
2002/0007752 A1 1/2002 Sakagami
2002/0116144 A1 8/2002 Yamauchi et al.

FOREIGN PATENT DOCUMENTS

JP 8-87198 A 4/1996
JP 8-95416 A 4/1996
JP 10-69187 A 3/1998
JP 10-104975 A 4/1998
JP 10-171296 A 6/1998

(Continued)

*Primary Examiner*—Sandra L Brase
(74) *Attorney, Agent, or Firm*—Birch, Stewart, Kolasch & Birch, LLP

(57) ABSTRACT

By controlling the temperature of a heating roller with high precision when in standby, good first-copy-out performance is obtained. In a fixing apparatus comprising a heating roller 1, a pressure roller 2, an induction coil 3*a* that generates magnetic flux, and a temperature detection member (such as a thermistor) 5 that detects the temperature of the heating roller 1, in which the heating roller 1 is caused to generated heat by generating an eddy current in a heat generating layer of the heating roller with magnetic flux generated by the induction coil 3*a*, the temperature of the heating roller 1 is controlled by disposing the temperature detection member 5 in a region where the maximum heat generating capacity of the heat generating portion of the heating roller 1 with induction heating is not less than 1/e, and thus an unusual rise in the temperature of the heating roller 1 is suppressed.

6 Claims, 10 Drawing Sheets

FOREIGN PATENT DOCUMENTS

| | | | |
|---|---|---|---|
| JP | 11-224024 | A | 8/1999 |
| JP | 2001-235964 | A | 8/2001 |
| JP | 2002-43048 | A | 2/2002 |
| JP | 2002-72755 | A | 3/2002 |
| JP | 2002-174981 | A | 6/2002 |

* cited by examiner

FIXING APPARATUS AND IMAGE FORMING APPARATUS

TECHNICAL FIELD

The present invention relates to a fixing apparatus that fixes a toner image on recording material with heat and pressure, and an image forming apparatus using that fixing apparatus.

BACKGROUND ART

Recently, in electrophotographic image forming apparatuses, heating roller-type fixing apparatuses have come into practical use with which stable fixing is possible while having a small size. This sort of heating roller-type fixing apparatus is configured such the it is provided with a heating roller that transports, while heating, recording paper to which a toner image constituted from powdered developer (toner) has been transferred, and a pressure roller that transports the recording paper while pressing it against this heating roller, and by allowing the recording material (paper) to pass at a fixing point, which is a pressing portion (nip portion) between the heating roller and the pressure roller, the toner image on the recording material is melted and pressed (fixed).

In a heating roller-type fixing apparatus, a heating system using a heat lamp is adopted. In an ordinary heat lamp heating system, a halogen lamp, which is a heat source, is disposed inside a heat generating structure such as a heating roller, and heating is performed uniformly from inside that heat generating structure.

In a heating roller-type fixing apparatus, conventionally, an aluminum member with a large heat capacity, whose walls have been made somewhat thick, is used as the heating roller, but with this sort of heating roller, there are the problems that not only does the start time until reaching a predetermined temperature (for example, 180° C.) necessary for fixing become long, but power consumption also becomes high, and so a way of dealing with those problems is sought.

Accordingly, tests have recently been performed in which the above problems are dealt with by attempting to make the wall of the heating roller thinner and reduce the heat capacity of the fixing apparatus, in order to shorten the start time of the fixing apparatus and aim for an energy conservation effect. Further, there is vigorous development of fixing apparatuses in which, by causing the heating roller or a film member itself to generate heat with electromagnetic induction heating instead of using a conventional heat lamp heating system, the start time of the fixing apparatus is further shortened, aiming for energy conservation.

With induction heating fixing systems, there may be a configuration in which an induction coil, which is a heat source, is disposed inside the heating structure of the heating roller or the like (internal heating system), and a configuration in which the induction coil is disposed outside the heating structure, i.e., facing the side that makes contact with a print face (external heating system). As the heating structure, below configurations (1) to (3) and the like are known.

(1) a heating structure in which a comparatively thick-walled metal roller is used and the entire roller is caused to generate heat (2) a heating structure in which sliding heat generating mm of tens of μm is caused to generate heat (3) a heating structure configured as a roller structure in which an elastic body such as an insulating sponge is provided inside a very thin metal heat generating layer, inside of which a cored bar is provided.

Of these configurations, with the configuration using a metal roller in (1), heat capacity is large in order to obtain rigidity as a roller structure, and so it is difficult to dramatically improve the startup time.

Also, with the film-sliding system in (2), the heat capacity of the heat generating layer is very small, so there is effect of shortening the startup time, but stable rotational driving is difficult, so this configuration is unsuitable for increasing speed.

On the other hand, with the roller structure system of (3), in which an elastic sponge layer is provided inside a thin metal heat generating layer, inside of which a cored bar is of metal or the like is provided, the heat generating layer is very thin and has a small heat capacity, same as the film-sliding system, and an insulating layer is also provided in this roller structure system, so that while being a roller structure, startup time can be shortened, and stable rotation is possible even at high speed due to the roller structure. Also, because the heating roller is an elastic structure, it is possible to form a wide nip, and so this configuration is suitable for a color fixing apparatus.

However, with this sort of roller structure in configuration (3), it is fundamentally necessary to externally dispose an induction coil. With a structure in which an induction coil is externally disposed, usually, the induction coil is disposed with a configuration such that it covers a semi-circumferential portion of the roller. Thus there exists a heating portion and a non-heating portion of the heating roller (partial heating), and when the heating roller is rotating, the heat generating layer gradually is introduced to a position facing the induction coil, and so the heating roller is uniformly heated. However, when heating is performed in a state in which the heating roller is not rotating, the heated region and the non-heated region become intermingled.

On the other hand, in a copier machine, from the standpoint of a user, the first-copy-out time is an important property, and as a method of realizing this property, a method is conceivable in which a standby mode is set, and in standby mode the heating roller is pre-heated. When the heating roller is pre-heated in standby mode, it is necessary to control the temperature of the heating roller using a temperature detection member. Various proposals have been made with respect to the position in which to install the temperature detection sensor (for example, see Patent Documents 1 and 2).

Patent Document 1: JP H10-104975A

Patent Document 2: JP 2002-72755A

DISCLOSURE OF INVENTION

Problem to be Solved by the Invention

Incidentally, with a structure in which a heating source is disposed outside of the heating roller (an external heating system), as described above, because heating and non-heating regions exist in the circumferential direction of the heating roller, when heating is performed with the heating roller stopped when in standby mode, the temperature varies according to the position in the roller circumferential direction. Particularly, an induction heating system has a configuration in which the heat generating layer generates heat directly, and the heat capacity of that layer is also small, and therefore the temperature quickly rises in the heating region, but in the non-heating region, conversely, heat is quickly released because the heat capacity is small. This is described in detail with reference to FIGS. 12 and 13. FIG. 12 shows the heat distribution of the heating roller from the induction coil and the installation position of a temperature detection member. FIG. 13 shows the results of measuring the temperature of the heating roller when startup was performed by heating while rolling the heating roller from room temperature to the temperature at which fixing is possible, 170° C., and afterwards stopping the heating roller and performing heating standby at a constant power of 150W.

In FIG. 13, with the coil center position (the position in FIG. 12 where θ=0) as a reference, at a position S1 where the heating roller is rotated 70 degrees in the paper transport direction (θ=70°), the roller temperature is rising after 20 seconds have passed from the beginning of standby. However, at a position S2 where the heating roller is rotated 145 degrees in the paper transport direction (θ=145°), about three minutes are needed until the heating roller temperature begins to rise, even though the heating roller is heated by the induction coil. Further, the degree of temperature increase differs at positions S1 and S2, and the degree of increase is larger at position S1. That is, when positions S1 and S2 are compared, there is less detection sensitivity at position S2, and so it is clear that the temperature of the region in the vicinity of the induction coil can not be controlled with good precision. Accordingly, when the temperature detection member is disposed at position S2 (in the non-heating region), in the worst case, the temperature of the region in the vicinity of the induction coil rises unusually, exposing the apparatus to heating roller smoke or fire. Also, the thermal limit of the heating roller may be exceeded, leading to damage or deterioration of the heating roller.

Here, in relation to temperature control of the heating roller, above JP H10-104975A describes establishing the installation position of the temperature detection member in the non-heating region, but when the temperature control member is installed in this position, for the reasons stated above, heating is difficult with the heating roller stopped when in standby, and so it is necessary to start up the heating roller from room temperature for each image output, so that a good first-copy-out time cannot be obtained. Above JP 2002-72755A also describes installing the temperature detection member in the non-heating region between coils, but even in the neighborhood between coils there are portions where there is little eddy current generation, so the same problems occur as described above.

The present invention was made in consideration of such circumstances, and it is an object thereof to provide a fixing apparatus in which heating roller temperature control can be performed with high precision when in standby, and in which a good first-copy-out function can be obtained, and to provide an image forming apparatus provided with a fixing apparatus possessing such characteristics.

MEANS FOR SOLVING PROBLEM

In the fixing apparatus of the present invention, a heating roller, a pressure roller that presses recording material to outer circumferential surface of the heating roller, a partial heating means that heats the heating roller, and a temperature detecting means that detects the temperature of the heating roller are provided, and the heating roller is heated by the partial heating means so that an image is fixed with heat on the recording material, which passes between the heating roller and the pressure roller, and a temperature detecting means is disposed in a region (heated region) of the heating roller heated by the partial heating means.

With the fixing apparatus of this present invention, because the temperature of the region of the heating roller heated by the partial heating means, i.e. the high-temperature region of the heating roller, is detected, even when the heating roller is heated in a stopped state when in standby, it is possible to suppress an unusual increase in the temperature of the heating roller. As a result, the danger of fire, smoke, and the like disappears. Further, it is possible to complete the return from standby to the temperature at which fixing is possible in a short period of time, so that good first-copy-out performance can be obtained.

In the fixing apparatus of this invention, the partial heating means may be provided inside of the heating roller, and it may be provided outside of the heating roller.

In the fixing apparatus of this invention, when the partial heating means is a heat source with an electromagnetic induction heating system that causes the heating roller to generate heat by generating an eddy current in a heat generating layer of the heating roller in a magnetic field generated by a magnetic flux generating means, and the magnetic flux generating means is disposed facing outer peripheral surface of the heating roller with a constant gap formed relative to outer peripheral surface of the heating roller, the temperature detecting means is disposed in a region where the heating roller surfaces the magnetic flux generating means. Also, in this case, it is preferable that the temperature detecting means is disposed in a region of not less than 1/e times the maximum amount of heat generation of the heat generating portion of the heating roller, and it is particularly preferable that the temperature detecting means is disposed at the position where the amount of heat generation of the heat generating portion of the heating roller is maximum.

In the fixing apparatus of the present invention, a heating roller, a pressure roller that presses recording material to outer circumferential surface of the heating roller, and a partial heating means that heats the heating roller are provided, and the heating roller is heated by the partial heating means so that an image is fixed with heat on the recording material, which passes between the heating roller and the pressure roller, and when the fixing apparatus is in standby, heating of the heating roller is performed by the partial heating means with a state which the heating roller is rotating.

With the fixing apparatus of this invention, because the heating roller is heated while rotating the heating roller during standby, even if heated locally by the partial heating means, it is possible to suppress temperature unevenness in the circumferential direction of the heating roller during standby, and it is possible to complete the return from standby mode to the temperature at which fixing is possible in a short period of time, so that good first-copy-out performance can be obtained. Further, it is possible to eliminate temperature unevenness due to temperature hysteresis in the circumferential direction of the heating roller even immediately after returning to the temperature at which fixing is possible, so that a good image without gloss unevenness or the like can be obtained.

In the fixing apparatus of this invention, it is preferable that the relationship between the rotation of the heating roller during standby and the rotation of the heating roller during fixing operation (during printing) is (revolution velocity of the heating roller during fixing operation)≧(revolution velocity of the heating roller during standby). By making the revolution velocity of the heating roller during standby not more than the revolution velocity of the heating roller during printing, it is possible to decrease temperature unevenness in the circumferential direction of the heating roller during standby, and to decrease the number of rotations of the heating roller during standby, so that a longer life can be achieved for the heating roller.

In the fixing apparatus of this invention, the rotation of the heating roller during standby may be either intermittent rotation or steady state rotation (continuous rotation). When intermittent rotation is adopted, it is possible to reduce the rotation time of the heating roller during standby, also contributing to longer life for the heating roller.

In the fixing apparatus of this invention, when intermittent rotation is adopted for the rotation of the heating roller during standby, a temperature detecting means that detects the temperature of the heating roller and a control means that controls intermittent rotation of the heating roller based on the detection value of this temperature detecting means may be provided, configured such that the control means rotates the heating roller a predetermined angle at the point in time that the detection value of the temperature detecting means has reached a set temperature that has been set in advance. When such a configuration is adopted, because the heating roller rotates after the temperature of the heat generating region of the heating roller has reached a constant temperature, in a state in which intermittent rotation is performed, it is possible to further reduce temperature unevenness in the circumferential direction of the heating roller when in standby.

In the fixing apparatus of this invention, when intermittent rotation is adopted for the rotation of the heating roller during standby, if the rotation angle of the heating roller when intermittently rotated is a rotation angle such that at least the heated region of the heating roller, which is heated by the partial heating means when the heating roller is in a stopped state, is positioned outside of the region where the partial heating means is disposed, because the heated region of the heating roller, heated when the heating roller was stopped during standby, is rotationally moved out of the region heated by the partial heating means, it is possible to further reduce temperature unevenness in the circumferential direction of the heating roller when in standby.

Also, if the rotation angle when intermittently rotating is made an angle such that the heating region of the heating roller is positioned at the nip portion of the heating roller and the pressure roller, because the heated region of the heating roller, i.e., the high temperature region, rotates to the region contacting the pressure roller, i.e., the low temperature region, it is possible to further reduce temperature unevenness in the circumferential direction of the heating roller when in standby, and the amount of heat supplied to the heating roller can be increased, so that it is possible to shorten the return time from the standby mode to the temperature at which fixing is possible.

In the fixing apparatus of this invention, when steady state rotation is adopted for the rotation of the heating roller, a temperature detecting means that detects the temperature of the heating roller and a control means may be provided, and configured such that driving/stopping of the partial heating means is controlled based on the detection value of this temperature detecting means.

In the fixing apparatus of this invention, when the partial heating means is a heat source with an electromagnetic induction heating system that causes the heating roller to generate heat by generating an eddy current in a heat generating layer of the heating roller with a magnetic field generated by a magnetic flux generating means, and the magnetic flux generating means is disposed facing the outer peripheral surface of the heating roller with a constant gap formed relative to the outer peripheral surface of the heating roller, the temperature detecting means is provided in a region where the heating roller surfaces the magnetic flux generating means. Also, in this case, it is preferable that the temperature detecting means is disposed in a region of not less than lie times the maximum heat generating capacity of the portion of the heating roller where heat is generated due to the magnetic flux generated by the magnetic flux generating means, and it is particularly preferable that the temperature detecting means is disposed at the site where the heat generating capacity of the heat generating portion of the heating roller becomes greatest.

In the fixing apparatus of this invention, it is preferable that the set temperature used for the control during standby is a temperature at which it is possible for the heating roller to reach the temperature at which fixing operation is possible by the time that the recording material begins to enter the fixing apparatus. When the temperature is set in this manner, because the heating roller reaches the temperature at which fixing is possible by the time that the recording material begins to enter the fixing operation apparatus, a good first copy time can be satisfied, and it is also possible to obtain a good image without image defects such as poor fixing.

Because the image forming apparatus of the present invention is provided with a fixing apparatus having the above characteristics, it is possible to complete the return from standby mode to the temperature at which fixing is possible in a short period of time, so that good first-copy-out performance can be obtained, and good image quality can be maintained.

Here, in the present invention, the reasons for making the heat generating region (heating region), where the temperature detecting means that detects the temperature of the heating roller is disposed, a region of not less than 1/e times the maximum amount of heat generation capacity of the heating roller, are as follows.

First, in induction heating, induction current is flowed to a conductor (the heat generating layer in the present invention) in a direction that negates a high frequency magnetic field generated in the conductor by high frequency current that has flowed to the induction coil, so that Joule heat is generated by the electrical resistance of the conductor and that induction current, and thus the conductor (heat generating layer) generates heat.

Incidentally, when the high frequency magnetic field has been caused to act on the heat generating layer, heat is not generated uniformly in the depthwise direction of the heat generating layer. The high frequency magnetic field, due to the skin effect, only acts near the surface of the heat generating layer, and when the induction current density of the region in which the high frequency magnetic field acts most strongly, i.e., the surface, is made 1, as shown in FIG. 11, the induction current density increases closer to the surface, and because the absorbed amount of the high frequency magnetic field decreases in the direction facing inside, the induction current density abruptly decreases. Here, where the electric resistance of the conductor is $\rho$, magnetic permeability is $\mu$, and the frequency of the high frequency current that flows to the induction coil is f, under the condition that the face of the conductor is flat and a uniform high frequency magnetic field acts at all locations on that surface, skin depth $\delta$ is expressed by $\delta=\sqrt{(\rho/\pi \cdot f \cdot \mu)}$.

In induction heating, due to the above skin effect, in a region with a depth of not less than the skin depth $\delta$, because the absorbed amount of the high frequency magnetic field is attenuated to not more than 1/e times, the induction current density becomes not more than 1/e times that of the surface, and in a region not less than this depth, almost no heat generation is contributed. Thus, the heat generating region can also be treated as a region having a heat generation amount of not less than 1/e times the maximum heat generation value.

Incidentally, in the above example, under the condition that a uniform high frequency magnetic field acts on the face of the heat generating layer, the region where a high frequency magnetic field acts with respect to the depthwise direction of the heat generating layer, i.e., the region where the heat generating layer generates heat with the induction current, was indicated, but as in the heating system adopted in the fixing apparatus of the present invention, for a heating roller constituted from a heat generating layer having a fixed and uniform thickness, in a configuration in which an induction coil is disposed facing a portion of the heating roller in the circumferential direction, a uniform high frequency magnetic field is not formed across the entire surface of the heat generating layer in the circumferential direction. Naturally, in a position facing the induction coil, the magnetic flux density that passes through the heat generating layer increases, and because more induction current flows, the amount of heat generated increases. On the other hand, in a position not facing the induction coil, the magnetic flux density that passes through the heat generating layer decreases, and because almost no induction current flows, almost no heat is generated.

In this way, with respect to the amount of heat generated in the circumferential direction of the heating roller, the amount of magnetic flux density that passes through the heat generating layer at respective positions in the circumferential direction is saved, and as that value increases, the induction current density and the amount of heat generated also increase. That is, the amount of heat generated in the circumferential direction of the heating roller also depends on the amount of magnetic flux density, i.e., the amount of magnetic flux density that passes through the heat generating layer, so that the amount of heat generated in the circumferential direction of the heating roller depends on the induction current density generated in the heat generating layer. Accordingly, the region that generates heat with the induction coil with respect to the circumferential direction of the heating roller can be treated as a region of not less than 1/e times the maximum heat generation quantity (Q0) obtained from the distribution of heat generation.

With the fixing apparatus of this present invention, because the temperature of the high temperature region of the heating roller is detected, even when the heating roller is heated in a stopped state, it is possible to suppress an unusual increase in the temperature of the heating roller. As a result, the danger of fire, smoke, and the like disappears. Further, it is possible to complete the return from standby mode to the temperature at which fixing is possible in a short period of time, so that good first-copy-out performance can be obtained.

EFFECTS OF THE INVENTION

With the fixing apparatus of this invention, because the heating roller is heated while rotating the heating roller during standby, even if heated locally by the partial heating means, it is possible to suppress temperature unevenness in the circumferential direction of the heating roller during standby, and it is possible to complete the return from standby mode to the temperature at which fixing is possible in a short period of time, so that good first-copy-out performance can be obtained. Further, it is possible to eliminate temperature unevenness due to temperature hysteresis in the circumferential direction of the heating roller even immediately after returning to the temperature at which fixing is possible, so that a good image without gloss unevenness or the like can be obtained.

With the image forming apparatus of the present invention, because a fixing apparatus having the above characteristics is provided, it is possible to complete the return from standby to the temperature at which fixing is possible in a short period of time, so that good first-copy-out performance can be obtained, and good image quality can be maintained.

DESCRIPTION OF REFERENCE NUMERALS

Figure 1:
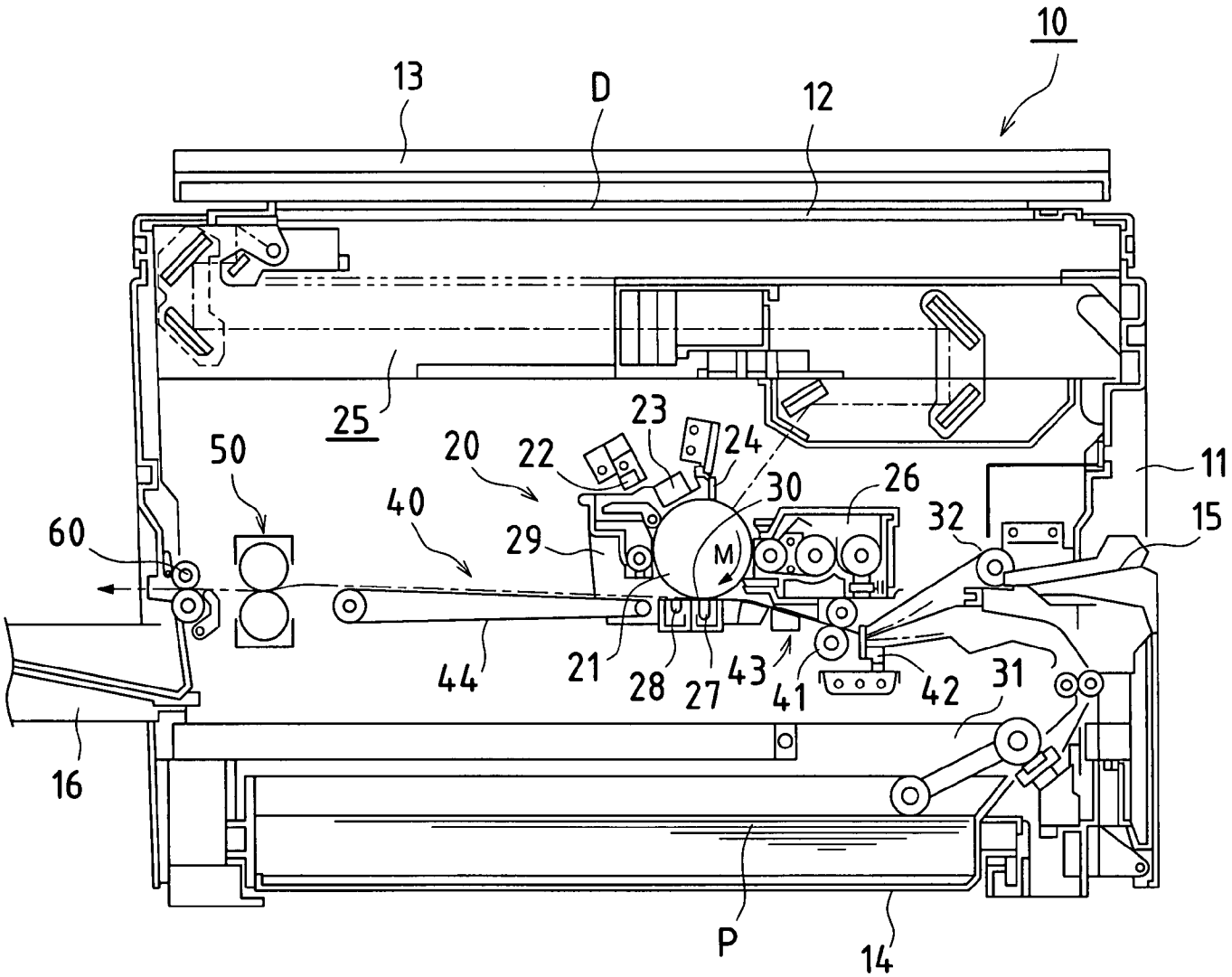
FIG. 1 is a cross-sectional view that shows an example of the image forming apparatus of the present invention.

1 heating roller
2 pressure roller
3 heat source (partial heating means)
3*a* induction coil
4 fixing entrance guide
5 temperature detection member
10 image forming apparatus
20 image forming portion
50 fixing apparatus
N fixing nip portion
P paper (recording material)

BEST MODE FOR CARRYING OUT THE INVENTION

Hereinafter, the present invention will be described by way of illustrative embodiments with reference to the drawings.

[A] Image Forming Apparatus

FIG. 1 is a cross-sectional view that shows an example of an image forming apparatus of the present invention.

An image forming apparatus 10 shown in FIG. 1 is provided with a casing-like apparatus main body 11, and inside that apparatus main body 11 an image forming portion 20 is disposed that forms an image with image forming processes such as charging, exposure, developing, transfer, and cleaning. Also, in the upper face of the apparatus main body 11, a glass platen 12 is disposed as an original placement stage, and a platen cover 13 is disposed that holds down an original D that has been set on this glass platen 12.

A control panel is disposed in the face front edge portion of the upper face of the apparatus main body 11 as an input/display means (not shown). In the bottom portion of the apparatus main body 11, a paper supply cassette 14 is installed in which paper (recording material) P is stored as an image carrier that is supplied to the image forming portion 20. A manual paper supply stage 15 is provided on the right side of the apparatus main body 11, and a discharge tray 16 that stores recording paper for which fixing is complete is disposed on the left side of the apparatus main body 11.

The image forming portion 20 is provided with a photosensitive drum 21 as an image carrier disposed in approximately the center portion inside the apparatus main body 11 such that the photosensitive drum 21 can be rotationally driven.

Around the perimeter of the photosensitive drum 21, in the direction of rotation (the direction of arrow M), a de-electrifying apparatus 22 (remaining charge removal means) that removes a remaining charge by irradiating light to the photosensitive drum 21, a charging apparatus 23 that uniformly charges the surface of the photosensitive drum 21, an LED removal array 24 that removes a charge from a non-image forming region, a movable optical exposing apparatus 25 (electrostatic latent image forming means) disposed in the upper portion within the apparatus main body 11, and a developing apparatus 26 that develops an electrostatic latent image formed on the surface of the photosensitive drum 21 by slit exposure with this exposing apparatus 25 using powdered developer (below, referred to as "toner"), are disposed in this order.

Also, around the perimeter of the photosensitive drum 21, a transfer apparatus 27 that transfers a toner image formed on this photosensitive drum 21 to the paper P (ordinary paper or an overhead projector sheet or the like) as an image carrier supplied from the paper supply cassette 14 or the manual paper supply stage 15, a detaching apparatus 28 that detaches the paper P to which the toner image has been transferred from the photosensitive drum 21, and a cleaner apparatus 29 that scrapes away toner that remains on the photosensitive drum 21, are disposed in this order.

Also, inside the apparatus main body, a paper transport path 40 is formed that guides paper P successively supplied from the paper supply cassette 14 via a paper supply apparatus 31 comprised of a pickup roller and a supply roller and the like, or paper P supplied via a paper supply apparatus 32 from the manual paper supply stage 15, to the discharge tray 16 via an image transfer portion 30 between the transfer apparatus 27 and the photosensitive drum 21.

In the paper transport path 40, positioned on the upstream side from the image transfer portion 30, a registration roller pair 41 that is used as both a positioning means and a transporting means is disposed, and a registration roller front detector 42 is disposed as a paper detecting means on the upstream side of the registration roller pair 41. Also, a penetration guide 43 is disposed between the registration roller pair 41 and the image transfer portion 30 as a paper guiding means.

Further, positioned on the downstream side from the image transfer portion 30, a transporting apparatus 44 that has an endless belt, a heating roller-type fixing apparatus 50 (details given below) and a discharge roller pair 60 are disposed.

In the above structure of the image forming apparatus 10, when copying the original D, the photosensitive drum 21 rotates in the direction of arrow M, and is uniformly charged by the charging apparatus 23 after a remaining charge is removed by the de-electrifying apparatus 22. Next, by scanning the original D on the photosensitive drum 21 that has been uniformly charged by the movable optical exposing apparatus 25, the original D is slit-exposed on the photosensitive drum, forming an electrostatic latent image that corresponds to the original D on the photosensitive drum 21.

That electrostatic latent image formed on the photosensitive drum 21 is developed by toner being provided by the developing apparatus 26, forming a toner image on the photosensitive drum 21. On the other hand, in parallel with this operation forming a toner image on the photosensitive drum 21, the leading edge of the paper P supplied from the paper supply cassette 14 or the manual paper supply stage 15 is positioned by the paper P colliding with the registration roller pair 41 that is stopped.

Then, after a predetermined time has passed from the point in time that leading edge detection is performed by the registration roller front detector 42, the registration roller pair 41 rotates and transport of the paper P towards the image transfer portion 30 begins. This transported paper P is guided by the penetration guide 43 such that the leading edge of the paper P adheres closely to the photosensitive drum 21 and fed into the image transport portion 30, and the toner image on the photosensitive drum 21 is transferred to the paper P by operation of the transfer apparatus 27. Next, the paper P to which the toner image has been transferred, after being detached by AC corona discharge with the detaching apparatus 28, is guided to the fixing apparatus 50 via the transporting apparatus 44, and the toner image is melted and fixed to the paper P by this fixing apparatus 50. After this toner image has been fixed, the recording paper P is discharged onto the discharge tray 16 by the discharge roller pair 60.

On the other hand, after the toner image if transferred to the paper P, remaining toner is removed from the photosensitive drum 21 by the cleaner apparatus 29, and the photosensitive drum 21 becomes able to perform the next copying operation. The image forming apparatus 10 shown in FIG. 1 is an example, and the configuration of an image forming apparatus in which the present invention is applied is not limited to this example.

[B] Fixing Apparatus

Next, an example of the fixing apparatus of the present invention will be described with reference to FIG. 2.

The fixing apparatus 50 in this example is configured from a heating roller 1 that is a heating rotating body, a pressure roller 2 that is a pressing rotating body that makes sliding contact (abuts) with the heating roller 1 from above, a heat source 3 that heats the heating roller 1, a fixing entrance guide 4, and a temperature detection member 5 that detects the temperature of the heating roller 1, and while applying heat and pressure to the recording paper with the heating roller 1 and the pressure roller 2, sandwiches and transports the paper P in the direction of arrow Kp.

Between the heating roller 1 and the pressure roller 2, a belt-like fixing nip portion N is formed in the lengthwise direction (direction perpendicular to the paper face in FIG. 2) of rollers 1 and 2, and the fixing entrance guide 4 is disposed on the upstream side of that fixing nip portion N (upstream side in the paper transport direction (direction of arrow Kp) of the paper P).

Next is a detailed description of each portion of the fixing apparatus 50.

Figure 3:
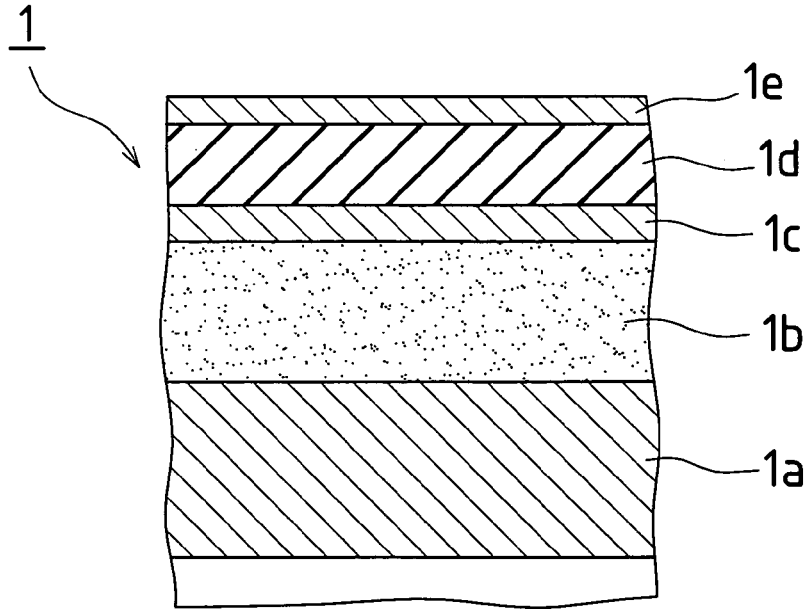
FIG. 3 is an enlarged cross-sectional view that schematically shows the principal structure of a heating roller that uses the fixing apparatus in FIG. 2.

The heating roller 1, as shown in the enlarged cross-sectional view in FIG. 3, for example, includes a cored bar 1*a* constituted from an aluminum tube with an outer diameter of 28 mm and a wall thickness of 3 mm, and has a configuration in which an elastic body layer (silicon sponge layer) 1*b* with a thickness of 6 mm, an adhesive layer (not shown), an Ni heat generating layer 1*c* with a thickness of 40 μm, a silicon rubber layer 1*d* with a thickness of 400 μm, and in the outermost surface layer, a PFA tube layer 1*e* with a thickness of 30 μm, are provided in the outer circumferential face of the cored bar 1*a*, in this order. This heating roller 1 is rotationally driven with a velocity V1 in the direction of arrow R1 by a driving means (not shown).

The pressure roller 2, for example, has a configuration in which an elastic body layer (silicon sponge layer) 2*b* with a thickness of 5 m, is provided on the outer circumferential face of a cored bar 2*a*, which is made of metal and has a diameter of 20 mm, and a PFA tube layer 2*c* with a thickness of 30 μm is provided on the outer circumferential face of the elastic body layer 2*b*. This pressure roller 2 is pressed and biased against the heating roller 1 with a predetermined sliding contact pressure (abutment pressure) by a restoring force delivery means (not shown), and thus, the above fixing nip portion N is formed between the heating roller 1 and the pressure roller 2. The fixing nip portion N is set to about 7 mm. With rotation of the heating roller 1 in the direction of arrow R1, the pressure roller 2 idly rotates in the direction of arrow R2.

The heat source 3 of the heating roller 1 is configured by an induction coil 3*a*. The induction coil 3*a* uses a coil in which a litz wire, in which approximately 10 to 150 insulation-coated copper wires with a wire diameter of about 0.1 to 0.8 mm are bundled, is wrapped approximately 5 to 20 times.

The induction coil 3*a* is housed in a holder case 3*b*, and is provided along the outer circumferential face of the heating roller 1, such that it covers roughly a semi-circumferential portion of the heating roller 1. The gap between the induction coil 3*a* and the heating roller 1 is kept at about 3 mm. The induction coil 3*a* is connected to an exciting circuit (not shown), and high frequency current of about 20 to 100 kHz is provided by the exciting circuit. The alternating flux that is generated by flowing this sort of high frequency current to the induction coil 3*a* acts on the Ni heat generating layer 1*c* that comprises the heating roller 1, and an eddy current is generated in the Ni heat generating layer 1*c*. The eddy current generated in the Ni heat generating layer 1*c* generates Joule heat due to the intrinsic resistance of the Ni heat generating layer 1*c*, and as a result the heating roller generates heat.

The fixing entrance guide 4 is disposed immediately on the upstream side of the fixing nip portion N in the transport direction of paper P (direction of arrow Kp), and is disposed so that when paper P on the surface of which a toner image is preserved is supplied to the fixing apparatus 50 in the image forming portion 20 (see FIG. 1), the fixing entrance guide 4 makes contact with the back face of that paper P, guides the paper P, and causes the leading edge of the paper P to properly and smoothly penetrate the fixing nip portion N.

The temperature detection member 5 is, for example, a thermistor, and detects the temperature of the region of the heating roller heated by the induction coil 3*a*. The temperature detection member 5 is disposed in a shape that slips in between the heating roller 1 and the induction coil 3*a*, i.e., in a state of contact with the heating roller 1 in the region facing the induction coil 3*a*. More specifically, the temperature detection member 5 is disposed on the downstream side of the fixing nip portion N between the heating roller 1 and the pressure roller 2, in a region of not less than 1/e the maximum heating portion of the induction coil 3*a*, that is, such that the temperature detection member 5 makes contact with the outer circumferential face of the heating roller 1 at position A in FIG. 4, described below.

By disposing the temperature detection member 5 in the region of the heating roller 1 heated by the induction coil 3*a* in this way, even when heating with the heating roller 1 in a stopped state when in standby, the temperature of the region heated by the induction coil 3*a* does not rise unusually, so that stable temperature control is possible, and the time necessary to return from the standby state can also be shortened. Such effects are described in detail with reference to FIGS. 5 to 8.

Figure 4:
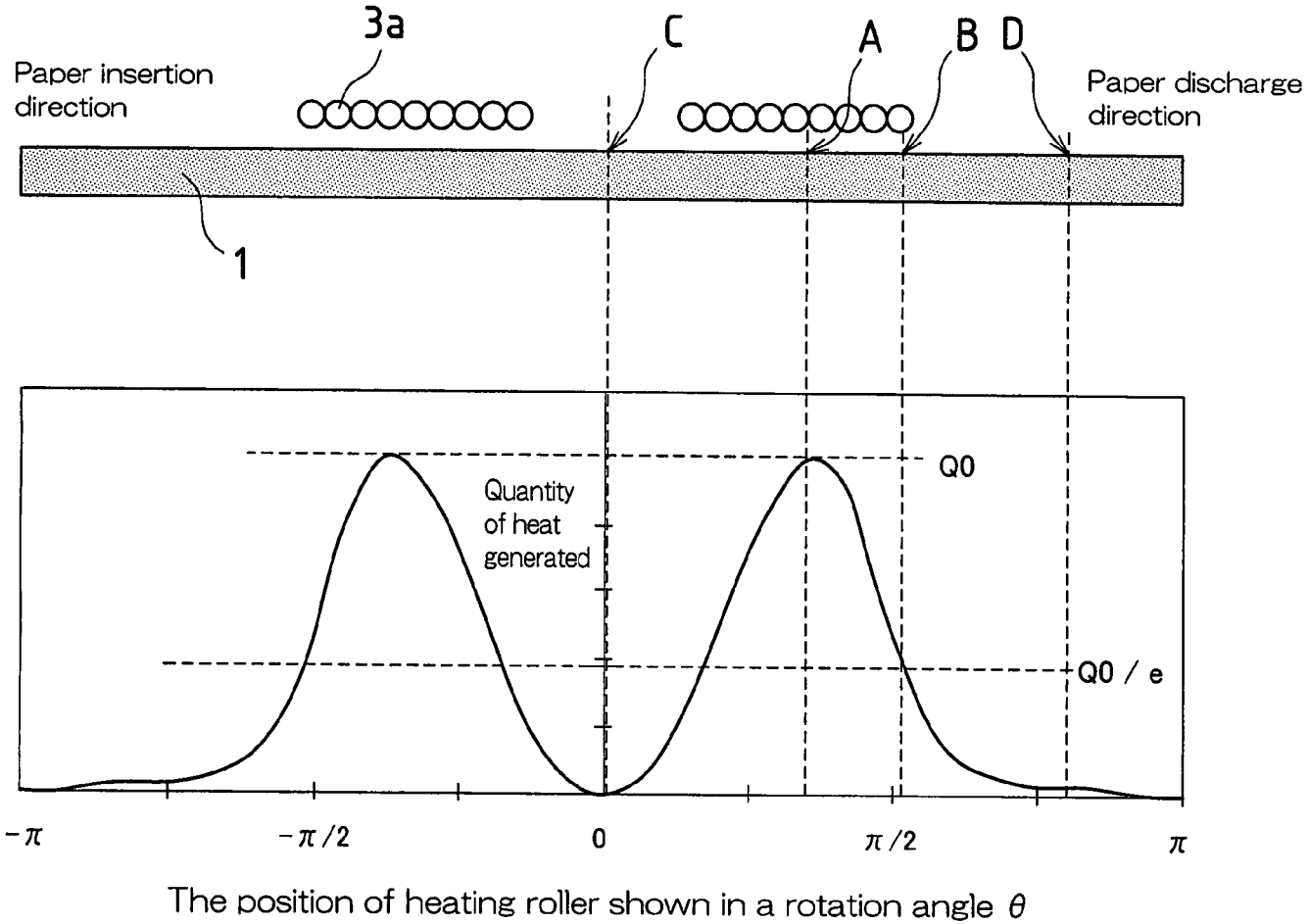
FIG. 4 shows the installation position and heat generating distribution of a temperature detection member.

FIGS. 5 to 8 show the results of disposing the temperature detection member 5 at positions A to D shown in FIG. 4, executing temperature control with respect to those temperature detection members 5 at positions A to D, and measuring the detection temperature of each temperature detection member 5. A thermistor was used as the temperature detection member 5.

Figure 5:
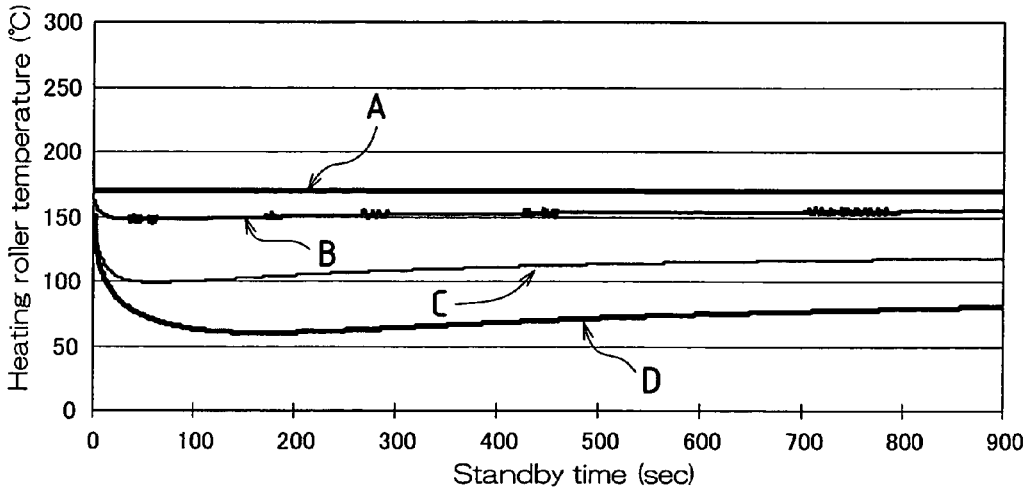
FIG. 5 is a graph that shows the temperature status of a heating roller when in standby.

First, FIG. 5 shows the detection temperature of each temperature detection member 5 when the thermistor was installed at position A, which is closest to the portion where the most heat is generated (position of maximum heat generation Q0), and placed in standby for 15 minutes at 170° C., which is the fixing set temperature. Naturally, the temperature of position A was maintained at 170° C., which is the set temperature of the heating roller 1 during standby.

On the other hand, at the other positions B to D, because the set temperature (170° C.) is not exceeded and the temperature of the heating roller does not rise unusually in parts, it is possible to stably control the temperature of the heating region. Further, when the roller 1 is rotated and returned immediately after 15 minutes in standby has passed, the return time is about 10 seconds, and relative to the 30 seconds of time needed to start up from room temperature, fixing can be performed in a sufficiently short time.

Next, a case in which constant temperature control was performed will be described based on the detected temperatures of positions B to D. The control temperature was determined referring to the results at position A shown in FIG. 5. Because the lowest temperature or a temperature near to the lowest temperature is detected at each position with a standby time of about one minute, temperature control was performed with the value after one minute of standby time. The temperatures at positions B, C, and D were 145° C., 100° C., and 70° C., respectively.

Figure 6:
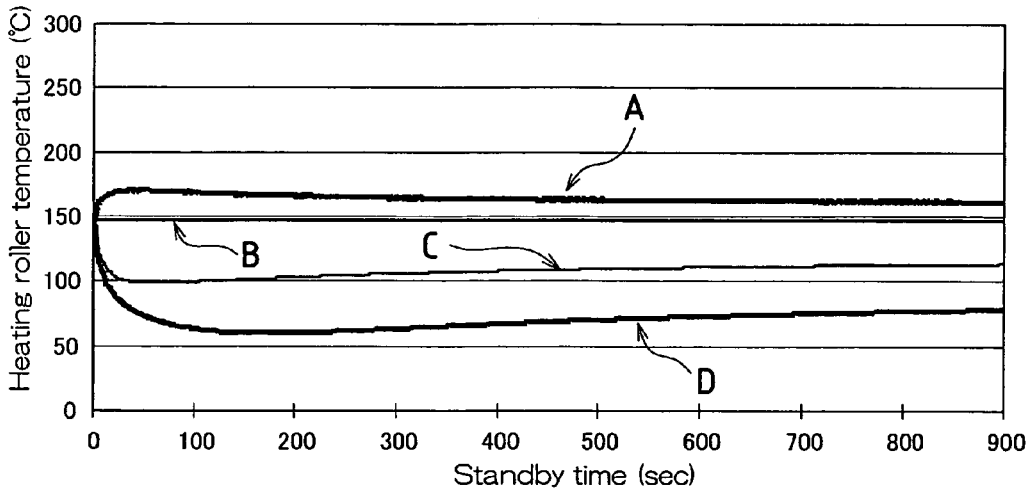
FIG. 6 is a graph that shows the temperature status of a heating roller when in standby.

First, the control shown in FIG. 6 is for a case in which constant temperature control was performed based on the detection temperature of position B, and from the results of position A, it is understood that when temperature control is performed at about 145° C., the temperature of position A, which is the most heated position, is stable in the vicinity of 160° C.

Figure 7:
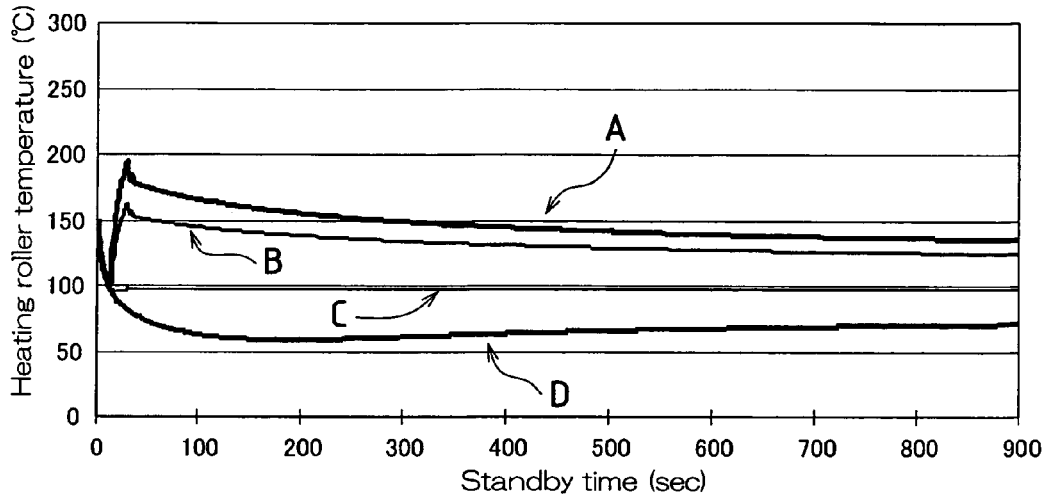
FIG. 7 is a graph that shows the temperature status of a heating roller when in standby.
Figure 8:
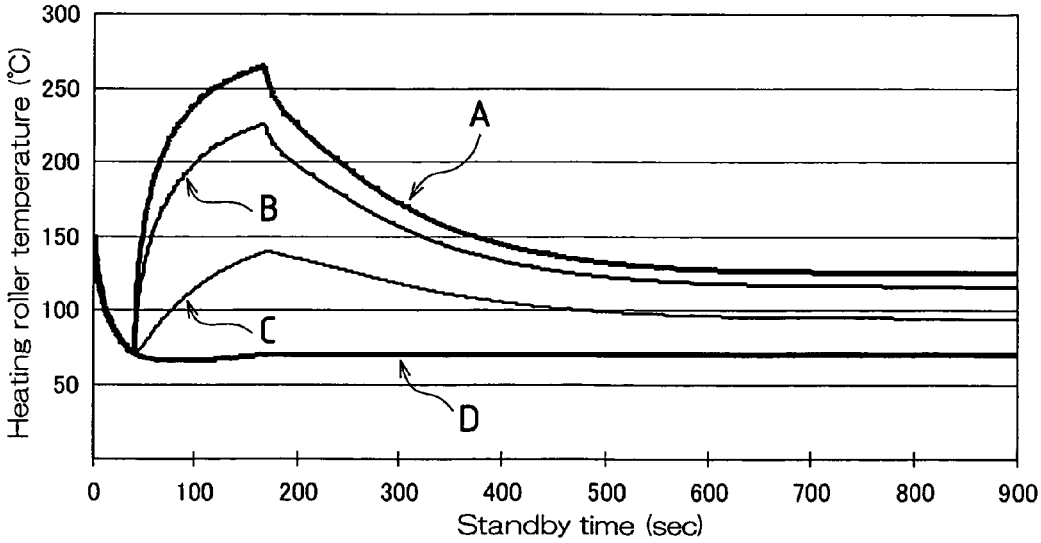
FIG. 8 is a graph that shows the temperature status of a heating roller when in standby.

On the other hand, as shown in FIG. 7, in a case in which constant temperature control was performed based on the detected temperature of position C (100° C.), because the temperature of position C exceeds 100° C. after about 15 seconds in standby, heating by the induction coil 3*a* is not performed, and the temperature of the entire heating roller 1 decreases to 100° C. However, along with the start of heating, at the most heated position A, the temperature instantly rises to about 200° C. Afterward, the temperature gradually decreases, and after 15 minutes have passed, the temperature decreases to 135° C. Further, as shown in FIG. 8, in a case in which constant temperature control is performed based on the detected temperature position D, the phenomenon described above becomes more prominent, and heating is performed until the temperature at the most heated position A rises to more than 260° C.

Here, as shown in FIG. 4, positions A and B correspond to heating regions, i.e. a heat generating region of not less than 1/e times the heat quantity Q0 of the position where maximum heat is generated, and on the other hand, positions C and D correspond to regions with less (not more than Q0/e) than positions A and B.

Accordingly, from the above results, by providing the temperature detection member 5 in a heat generating region, i.e. a region of not less than 1/e times the heat generating quantity Q0 of the maximum heat generating portion of the heating roller 1, and detecting/controlling the temperature of the heating roller 1, even when heating with the heating roller 1 in a stopped state when in standby, it is possible to avoid the danger of fire, smoke and the like from an unusual rise in temperature in the heating region. Further, it is possible to prevent problems occurring due to the temperature of the heating region exceeding the upper temperature limit of the heating roller 1, i.e., damage or deterioration of the heating roller 1. Moreover, the time to return from standby mode can also be shortened, so that it is possible to shorten the first-copy time.

Figure 9:
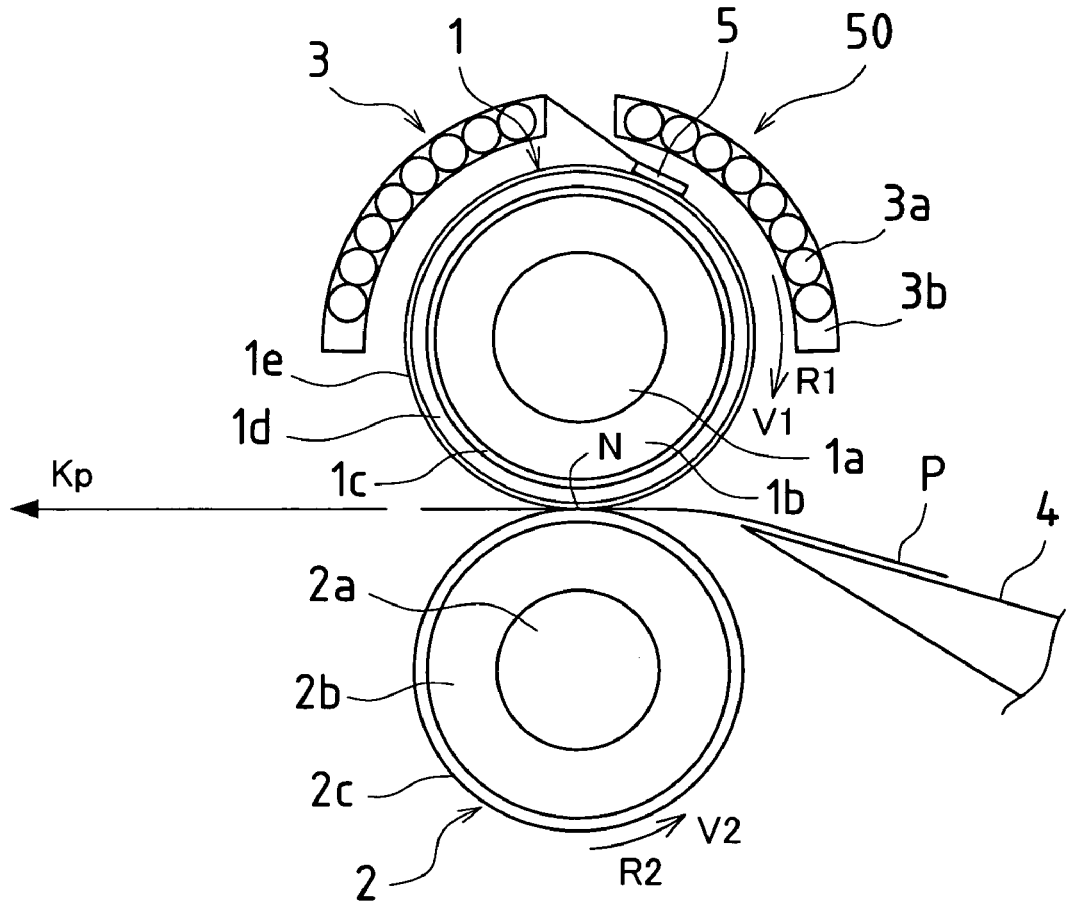
FIG. 9 is a cross-sectional view that shows another example of the fixing apparatus of the present invention.

The disposed position of the temperature detection member 5 is not limited to the position shown in FIG. 1, and may be a region where the heating roller 1 faces the induction coil 3*a*; for example, the temperature detection member 5 may be disposed in a position as shown in FIG. 9.

Figure 10:
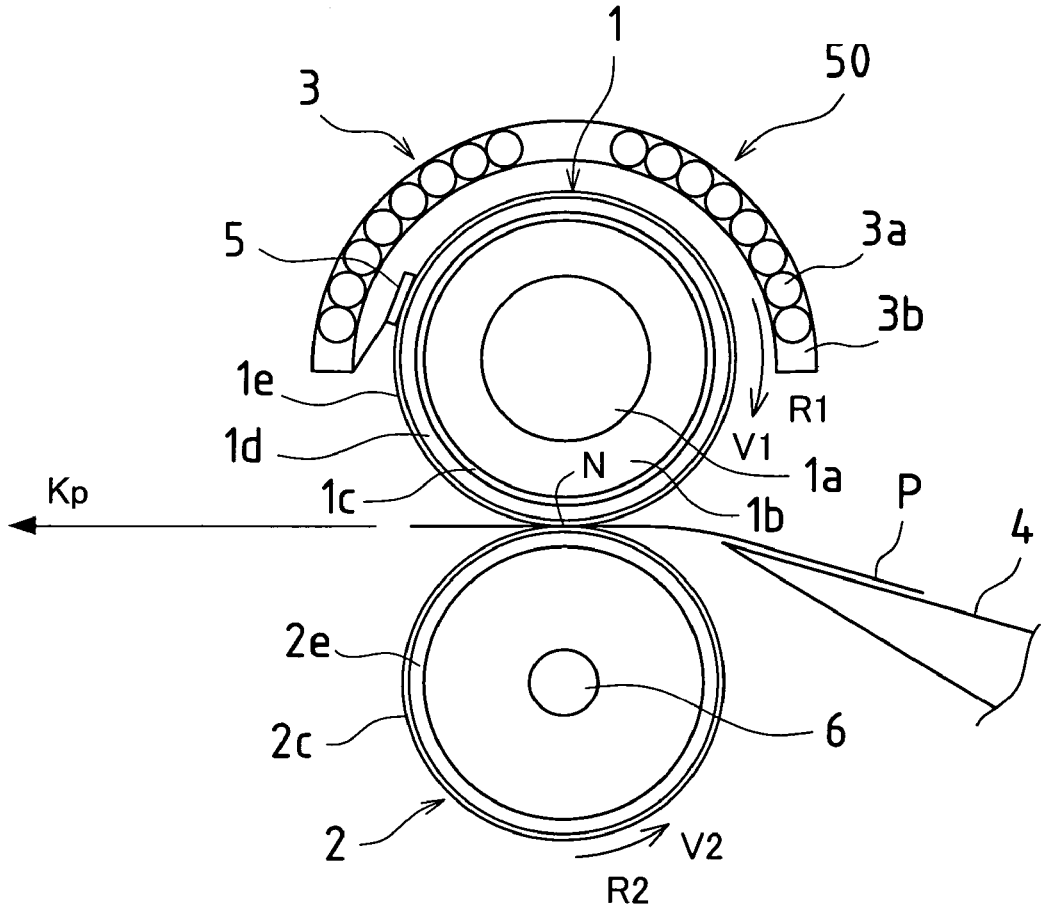
FIG. 10 is a cross-sectional view that shows still another example of the fixing apparatus of the present invention.
Figure 11:
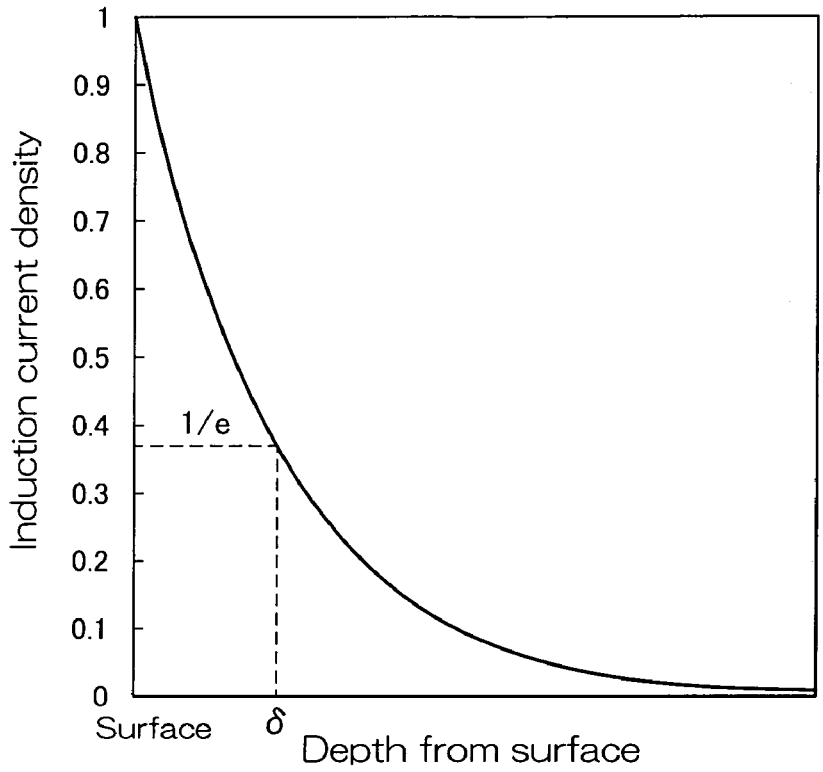
FIG. 11 is a graph that shows the relationship between the depth from the surface of a heat generating layer and induction current density in induction heating.
Figure 12:
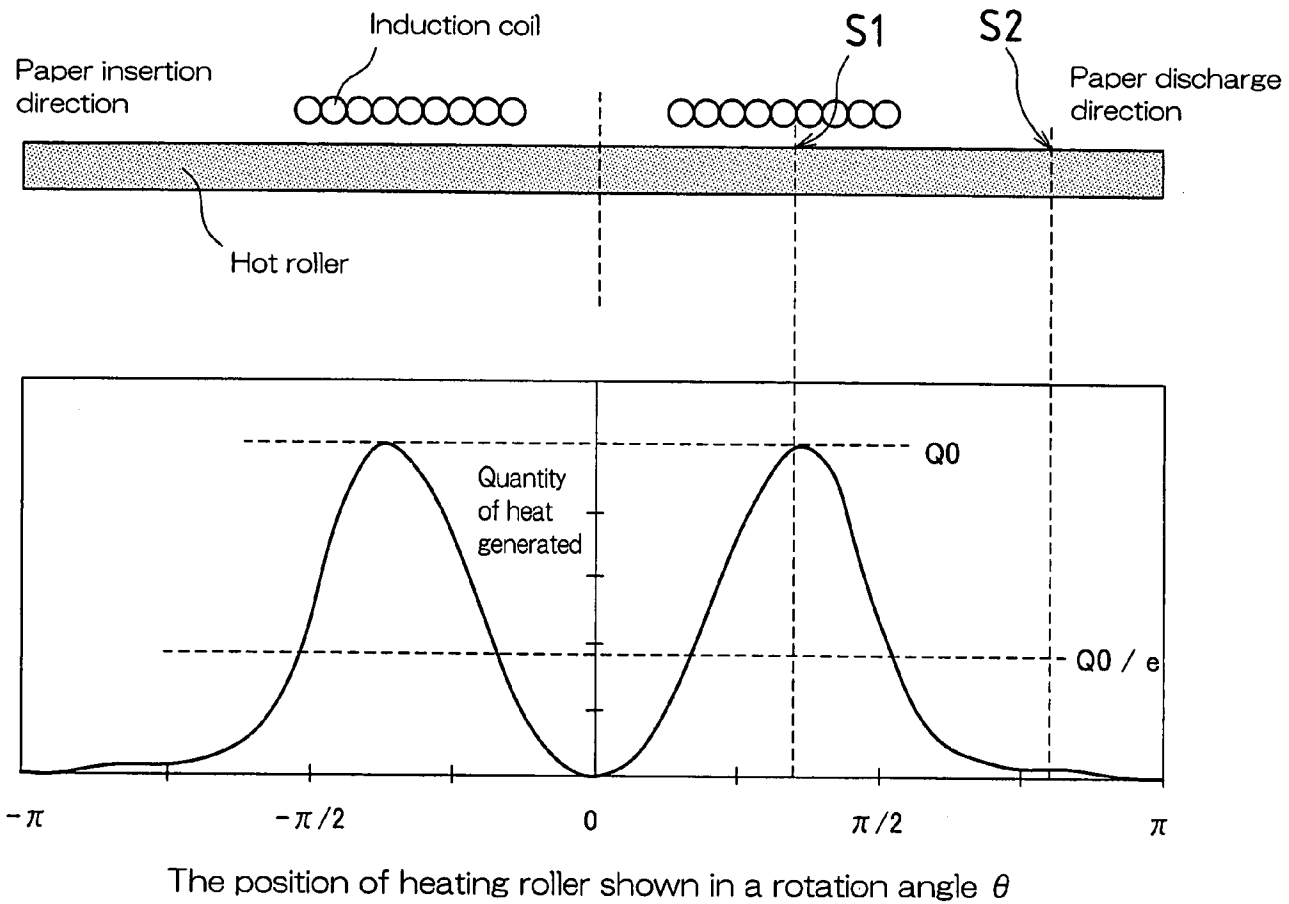
FIG. 12 shows the installed position of a temperature detection member and the heat distribution in a fixing apparatus with an induction heating system.
Figure 13:
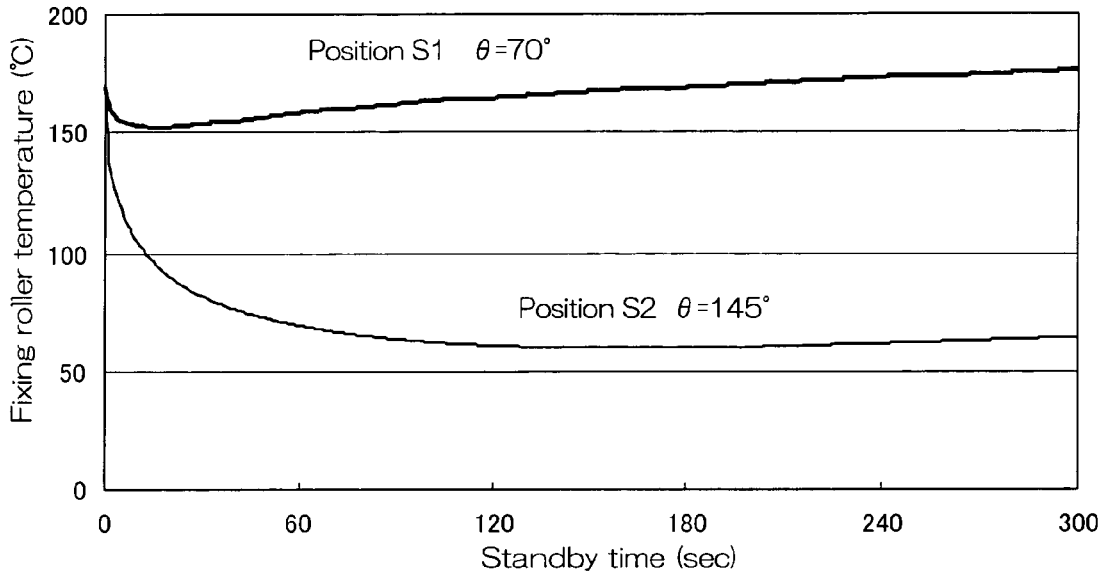
FIG. 13 is a graph that shows the results of measuring the temperature of the heating roller when in standby in FIG. 12.

Also, the fixing apparatus 50, for example, as shown in FIG. 10, may have a configuration in which the pressure roller 2 is provided with a PFA coating layer 2*c* of about 20 μm on an aluminum metal roller surface 2*e* with a thickness of about 1 mm, and by providing a halogen lamp 6 inside the pressure roller 2, the pressure roller 2 is also heated. When adopting this sort of configuration, when in standby, at the same time that the heating roller 1 is heated by the induction coil 3*a*, the heat from the pressure roller 2 is transmitted through the fixing nip roller portion N and the heating roller 1 is heated.

[C] Rotational Control of Heating Roller

Next is a description of a specific example when the heating roller 1 is rotated when in standby.

First, as described above, FIG. 5 shows the results when the heating roller 1 was not rotated at all, and temperature control of the heating roller 1 (control of power to the induction coil 3*a*) was performed based on the detection value of the temperature detection member 5 disposed at position A in FIG. 4. As is clear from FIG. 5, the temperature of position A, where the temperature of the heating roller 1 becomes highest, is kept constant at 170° C., while on the other hand, at position D, where the temperature is low, the temperature decreases for about three minutes after standby, and subsequently the temperature gradually rises and the temperature difference between position A and position D gradually disappears, but still a temperature difference (temperature unevenness) is present.

Such temperature unevenness may remain as hysteresis when returning from standby mode, and as a result, uneven gloss of the image may be caused. Rotating the heating roller 1 during standby is effective for dealing with such a problem. The method of rotating the heating roller 1 during standby may involve either steady state rotation or intermittent rotation. However, when the heating roller 1 is rotated with a greater velocity than the revolution velocity during printing, because deterioration of the heating roller 1 or the pressure roller 2 may be hastened, it is preferable to make the revolution velocity during standby not more than the revolution velocity during printing.

[C-1] Control of Intermittent Rotation of Heating Roller

Following is a description of control of intermittent rotation of the heating roller.

First, with the temperature detection member 5 disposed at position A shown in FIG. 4, the return time after being in standby for 10 minutes with a control temperature of 120° C., and gloss unevenness when fixing a solid image immediately after returning to the fixing temperature 170° C., were evaluated. Those results are shown in Table 1 below.

TABLE 1

| | 170° C. Return Time | Image gloss unevenness |
|---|---|---|
| Intermittent rotation | 13.5 seconds | mediocre |
| No intermittent rotation | 12.5 seconds | good |

From the results in Table 1, it is understood that when the heating roller 1 is not rotated at all during standby, some amount of gloss unevenness appears.

When the heating roller 1 was rotated through half of a rotation during standby with a ratio of once per two minute, and the return time to 170° C. and the gloss evenness of the contact image immediately after return were evaluated at the point in time that the total time elapsed in standby reached 10 minutes, it was possible to make the temperature of the heating roller 1 uniform by rotating the heating roller 1 at each predetermined time (intermittent rotation), and it was possible to shorten the return time and to improve the image unevenness of the fixed image. The reason that such effects were obtained is that due to the region heated when heating was performed with the heating roller 1 in a stopped state being rotated by rotation of the heating roller 1 to the region where heat is not generated by the induction coil 3*a*, and conversely, due to the non-heated region of the heating roller 1 moving to the region where heat is generated by the induction coil 3*a*, it is possible to reduce temperature unevenness in the circumferential direction of the heating roller 1 during standby, and as a result, an image without gloss unevenness was obtained.

Further, when the heated region of the heating roller 1 is rotated such that it is positioned at the fixing nip portion N with the pressure roller 2, it becomes possible to increase the amount of heat supplied to the pressure roller 2 even during standby, and the return time can also be shortened.

The above intermittent rotation operation is for a case in which the heating roller 1 is rotated at each predetermined time, but the present invention is not limited to this, and intermittent rotation may also be controlled using the temperature detection information of the heating roller 1.

Figure 2:
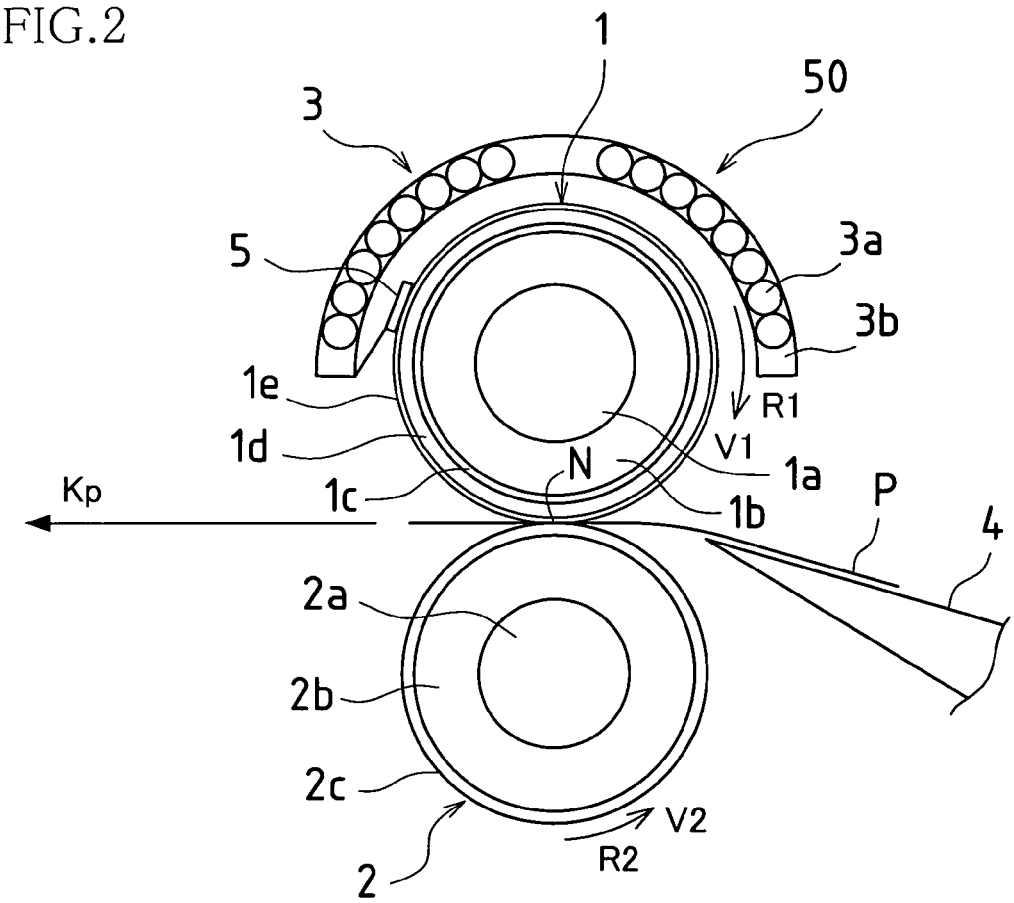
FIG. 2 is a cross-sectional view that shows an example of the fixing apparatus of the present invention.

In this case, as shown in FIG. 2, control may be performed in which, at the point in time that the detection value of the temperature detection member 5 disposed in the heat generating region of the heating roller 1 has reached a set temperature (for example, 160 degrees) that has been set in advance, the heating roller 1 is rotated a predetermined angle (for example, half a rotation). Also, in this case, in order to shorten the first copy time, it is preferable to set the above set temperature to a temperature such that after a print start signal has been sent, the heating roller 1 can reach a temperature at which fixing is possible within the time until the paper P protrudes into the fixing nip.

In this way, by providing the temperature detection member 5 in the heat generating region and detecting the temperature of the heating roller 1 and executing temperature control based on that temperature information, at the same time as intermittently rotating the heating roller 1 based on a predetermined time interval or the temperature information of the temperature detection member 5 also during standby, it becomes possible to shorten the return time and first copy time, and also to eliminate image unevenness.

The above sort of rotational control may be performed by providing a dedicated control portion of the fixing apparatus 50, and it may be performed with a controller of the image forming apparatus 10.

[C-2] Temperature Control of Heating roller During Steady State Rotation

When heating is performed while rotating the heating roller 1 with steady state rotation during standby, on/off control may be performed in which, based on the detection value of the temperature detection member 5 disposed in the heat-generating region of the heating roller 1, power is provided to the induction coil 3*a* when the detection value of that temperature detection member 5 is not more than the set temperature (for example, 150° C.) that has been set in advance, and power to the induction coil 3*a* is turned off when the detection value of the temperature detection member 5 has reached the set temperature. Such control may be executed by providing a dedicated control portion of the fixing apparatus 50, and it may be performed with a controller of the image forming apparatus 10.

Here, in the above embodiment, an example was described in which the present invention was applied in a fixing apparatus with a configuration in which an induction coil is disposed as a heating source outside of a heating roller (an external heating system), but the present invention is not limited to this, and can also be applied in a fixing apparatus with an internal heating system, in which the heating source is disposed inside the heating roller. Further, the heating source is not limited to an induction coil; a heating source with a configuration in which, for example, the heating roller is locally heated by various halogen lamps or the like, may also be adopted.

Also, the present invention is not limited to a fixing apparatus and image forming apparatus with the configurations indicated with the above embodiments; the present invention can be applied regardless of configuration or form, if the fixing apparatus is at least provided with a heating rotating body that is heated by a heating source, and a pressure rotating body that makes sliding contact with that heated rotating body and forms a fixing nip portion between the heating rotating body and the pressure rotating body, and while recording material (paper) to which an unfixed toner image has been transferred is transported sandwiched by the fixing nip portion, the unfixed toner image is fixed to the surface of the recording material by applying heat and pressure. In the above embodiments, an image forming apparatus for monochrome images was described in which a latent image formed on a photosensitive drum is formed by exposing reflected light from an original onto the photosensitive drum, but the present invention can also be applied in an image forming apparatus such as a copy machine, printer, fax, or the like that uses, for example, an LED or laser writing system, and moreover, it is of course also useful in a fixing apparatus for color images.

INDUSTRIAL APPLICABILITY

The present invention can be effectively used to fix an image on paper with heat in an image forming apparatus or the like. When using the fixing apparatus of the present invention, there is no danger of fire or smoke, and a good first-copy-out function can be obtained. Further, it is possible to maintain good image quality in the image forming apparatus.

The invention claimed is:

1. A fixing apparatus comprising a heating roller, a pressure roller that presses recording material to outer circumferential surface of the heating roller, a partial heating means that heats the heating roller, and a temperature detecting means that detects the temperature of the heating roller, in which the heating roller is heated by the partial heating means so that an image is fixed with heat on the recording material, which passes between the heating roller and the pressure roller, wherein the temperature detecting means is disposed in a region of the heating roller heated by the partial heating means, and wherein the temperature detecting means is disposed in a region where the maximum amount of heat generation of the heat generating portion of the heating roller is not less than 1/e times.

2. The fixing apparatus according to claim 1, wherein the partial heating means is provided inside of the heating roller.

3. The fixing apparatus according to claim 1, wherein the partial heating means is provided outside of the heating roller.

4. The fixing apparatus according to claim 3, wherein the partial heating means is a heat source with an electromagnetic induction heating system that causes the heating roller to generate heat by generating an eddy current in a heat generating layer of the heating roller in a magnetic field generated by a magnetic flux generating means, the magnetic flux generating means is disposed facing the outer peripheral surface of the heating roller with a constant gap formed relative to the outer peripheral surface of the heating roller, and the temperature detecting means is disposed in a region where the heating roller faces the magnetic flux generating means.

5. The fixing apparatus according to claim 1, wherein the temperature detecting means is disposed at the position where the amount of heat generation of the heat generating portion of the heating roller is maximum.

6. An image forming apparatus comprising the fixing apparatus according to claim 1.

* * * * *